US006796882B1

(12) United States Patent
Pulcher et al.

(10) Patent No.: US 6,796,882 B1
(45) Date of Patent: Sep. 28, 2004

(54) APPLIQUÉ FILM AND PAINT TREATMENT REMOVAL TOOL

(75) Inventors: Daniel E. Pulcher, Florissant, MO (US); Roy L. Tribble, Manchester, MO (US); Marvin C. Holwager, O'Fallon, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/654,706

(22) Filed: Sep. 3, 2003

(51) Int. Cl.[7] ..... B24B 1/00

(52) U.S. Cl. ..... 451/28; 451/51; 451/52; 451/177; 451/178; 451/180; 451/190; 451/344; 451/360

(58) Field of Search ..... 451/28, 51, 52, 451/177, 178, 180, 190, 344, 360

(56) References Cited

U.S. PATENT DOCUMENTS 4,256,510 A * 3/1981 Thompson et al. ..... 134/6
5,566,666 A * 10/1996 Sj odin ..... 125/15
6,533,505 B1 * 3/2003 Robinson ..... 408/1 R

* cited by examiner

*Primary Examiner*—Joseph J. Hail, III
*Assistant Examiner*—Shantese L. McDonald
(74) *Attorney, Agent, or Firm*—Shimokaji & Associates, P.C.

(57) ABSTRACT

An appliqué film and paint removal tool includes a central rotating shaft, a spring-loaded locator pin, at least three freely rotating bearings, an arbor, and a collar. The rotating shaft may be centered with the locator pin and pushed down until the bearings touch the surface from which the appliqué or paint material is to be removed. By rotating while touching the mold line contour of the fastener the bearings will cause the appliqué film or paint treatment to separate around the mold line of the fastener. The separated material than can be peeled off and the fastener is accessible. Therefore, the appliqué film or paint treatment can be removed from fasteners without damaging the surface around the fastener. The appliqué film and paint treatment removal tool may be designed to accommodate all fastener diameters and mold line contours.

32 Claims, 5 Drawing Sheets

APPLIQUÉ FILM AND PAINT TREATMENT REMOVAL TOOL

BACKGROUND OF THE INVENTION

The present invention generally relates to paint removal tools and methods for removing paint coatings and, more particularly, to an appliqué film and paint treatment removal tool and a method for locally removing an appliqué film and paint treatment.

Advanced aircraft, such as the F-18/EF, require the application of various advanced paint treatments or appliqué films to the mold line surface of the aircraft. Newly developed appliqué materials and other specialty coatings are of special interest for the aircraft industry since they provide a better corrosion protection than currently used paint treatments and have environmental and numerous other advantages over currently used paint treatments. The use of the appliqué materials and other specialty coatings is currently limited by the lack of production application methods that are cost effective and technically viable. One of the major problem areas is the cost of providing access to the mold line aircraft doors after the application of the paint or appliqué material. After application the paint treatments as well as the appliqué films cover the whole mold line surface of the aircraft including door access fasteners and latches. Consequently, direct access to the doors is precluded. This is a serious problem since a typical aircraft, such as the F-18/EF, has over 400 doors and thousands of removable fasteners that hold the doors in place.

Prior art methods utilized to remove the paint treatment or appliqué films from the door access fasteners and latches include cutting by hand around each fastener with a sharp knife, such as an exacto knife or similar cutting tool, and omission of paint or appliqué material in the areas of the door access fasteners and latches. Both prior art methods are costly and have disadvantages that limit the use of the paint treatments and appliqué films. Cutting on the mold line of an aircraft needs to be done manually and is labor intensive and time consuming. Further, using sharp cutting tools to cut around the door access fastener to remove the paint or appliqué material covering the door access fastener has a relatively high potential of damaging the aircraft structure. Cutting trough the paint or appliqué material into the outer skins of the aircraft could result in stress risers. Omission of the paint or appliqué material in the areas of the door access fasteners and latches requires the application of alternate treatments in these areas, which is costly and time consuming. If this alternate treatment is a paint type treatment the aircraft must be masked to omit paint in the areas that already received the paint treatment or the appliqué film, greatly increasing manufacturing costs. If the alternate treatment in the door access fastener area is a separate appliqué strip applied over the fastener area where it was initially omitted this strip is a constant maintenance and cost burden. The separate strip of appliqué material must be removed and reapplied every time a door is accessed. This increases labor time to remove and reinstall doors during fleet maintenance, increasing the cost and time needed for the fleet maintenance.

There has, therefore, arisen a need to provide a tool that makes it possible to quickly remove paint treatments and appliqué films from the door access fasteners after the application of paint treatments or appliqué films to the mold line surface of the aircraft without damaging the aircraft structure. There has further arisen a need to provide a tool that allows to remove the paint treatment and appliqué films locally from the door access fasteners at a relatively low cost and within a relatively short time. There has also arisen a need to provide a method for removing the paint treatment and appliqué films locally from the door access fasteners that allows the usage of advanced coatings and appliqué films on aircraft. There has further arisen a need to provide a method for removing the paint treatment and appliqué films locally from the door access fasteners that reduces the cost and time needed for aircraft fleet maintenance.

As can be seen, there is a need for an appliqué film and paint treatment removal tool that makes it possible to remove paint treatments or appliqué films locally from the door access fasteners after the application of paint treatments or appliqué films to the mold line surface of the aircraft without damaging the aircraft structure. Further, there is a need for an appliqué film and paint treatment removal tool that allows relatively fast, local removal of paint material of appliqué material covering door access fasteners in the airplane mold line, with reduced manual labor, at a relatively low cost, and within a relatively short time. Moreover, there is a need for a method for removing the paint treatment or appliqué films locally from the door access fasteners that allows the usage of advanced coatings and appliqué films on aircraft.

SUMMARY OF THE INVENTION

The present invention provides an appliqué film and paint treatment removal tool that is suitable for, but not limited to, the removal of paint treatments and appliqué films from the door access fasteners after the application of paint treatments or appliqué films to the mold line surface of the aircraft. The present invention further provides an appliqué film and paint treatment removal tool that makes it possible to remove paint and appliqué material quickly and locally without damaging the aircraft structure. The present invention also provides an inexpensive appliqué film and paint treatment removal tool that has a simple mechanical design, is relatively easy to operate at a low cost and with low maintenance. The present invention further provides a method for removing the paint treatment and appliqué films locally from the door access fasteners that allows the usage of advanced coatings and appliqué films on aircraft.

In one aspect of the present invention, an appliqué film and paint treatment removal tool comprises a central rotating shaft, at least three bearings, a cylindrical cavity, a locator pin, a spring, an arbor, and a collar. The central rotating shaft has a cylindrical shape and a central longitudinal axis, the central rotating shaft extends along the axis, is rotatable about the axis, and includes a first end and a second end, wherein the first end has a conically shape and includes at least three cavities equidistant from the central longitudinal axis and evenly spaced about the first end. Each of the at least three bearings is inserted into a corresponding cavity of the at least three cavities of the first end of the central rotating shaft. The cylindrical cavity extends within the central rotating shaft along the central longitudinal axis from the first end to the second end, wherein the cylindrical cavity includes a first portion having a first diameter and a second portion having a second diameter, and wherein the first diameter is smaller than the second diameter. The locator pin includes an elongated body, a shoulder and a tip, wherein the locator pin is inserted into the cylindrical cavity, wherein the locator pin is movable along the central longitudinal axis, and wherein the body of the locator pin extends the first end of the central rotating shaft, and wherein the shoulder of the locator pin has a diameter larger than the first diameter of the first portion of the cylindrical cavity. The spring is placed into the cylindrical cavity following the locator pin. The arbor has an elongated cylindrical shape and includes a first end and a shank portion, wherein the first end is disposed into the second portion of the cylindrical cavity extending coaxially with the central longitudinal axis forming a rigid connection. The collar is mounted onto the arbor, wherein the arbor is able to rotate inside the collar.

In another aspect of the present invention, an appliqué film and paint treatment removal tool comprises a central rotating shaft, at least three post bearings, a cylindrical cavity, a locator pin, a spring, an arbor, and a cylindrical collar. The central rotating shaft has a cylindrical shape and a central longitudinal axis, the central rotating shaft extends along the axis, is rotatable about the axis, and includes a first end and a second end, wherein the first end has a conically shape and includes at least three cavities equidistant from the central longitudinal axis and evenly spaced about the first end. Each of the at least three post bearings has a cylindrical body and is inserted into a corresponding cavity of the at least three cavities of the first end of the central rotating shaft. The post bearings are able to rotate about themselves. The cylindrical cavity extends within the central rotating shaft along the central longitudinal axis from the first end to the second end, wherein the cylindrical cavity includes a first portion having a first diameter and a second portion having a second diameter, and wherein the first diameter is smaller than the second diameter. The locator pin includes an elongated body, a shoulder and a tip, wherein the locator pin is inserted into the cylindrical cavity, wherein the locator pin is movable along the central longitudinal axis, and wherein the body of the locator pin extends the first end of the central rotating shaft, and wherein the shoulder of the locator pin has a diameter larger than the first diameter of the first portion of the cylindrical cavity. The spring is placed into the cylindrical cavity following the locator pin. The arbor has an elongated cylindrical shape and includes a first end and a shank portion, wherein the first end is disposed into the second portion of the cylindrical cavity extending coaxially with the central longitudinal axis forming a rigid connection. The cylindrical collar is mounted onto the arbor, wherein the arbor is able to rotate inside the collar.

In still another aspect of the present invention, an aircraft appliqué film and paint treatment removal tool comprises a central rotating shaft, at least three round ball bearings, a cylindrical cavity, a locator pin, a spring, an arbor, and a cylindrical collar. The central rotating shaft has a cylindrical shape and a central longitudinal axis, the central rotating shaft extends along the axis, is rotatable about the axis, and includes a first end and a second end, wherein the first end has a conically shape and includes at least three cavities equidistant from the central longitudinal axis and evenly spaced about the first end. Each of the at least three round ball bearings is inserted into a corresponding cavity of the at least three cavities of the first end of the central rotating shaft. The cylindrical cavity extends within the central rotating shaft along the central longitudinal axis from the first end to the second end, wherein the cylindrical cavity includes a first portion having a first diameter and a second portion having a second diameter, and wherein the first diameter is smaller than the second diameter. The locator pin includes an elongated cylindrical body, a shoulder and a tip, wherein the locator pin is inserted into the cylindrical cavity, wherein the locator pin is movable along the central longitudinal axis, and wherein the body of the locator pin extends the first end of the central rotating shaft, and wherein the shoulder of the locator pin has a diameter larger than the first diameter of the first portion of the cylindrical cavity. The spring is placed into the cylindrical cavity following the locator pin. The arbor has an elongated cylindrical shape and includes a first end and a shank portion, wherein the first end is disposed into the second portion of the cylindrical cavity extending coaxially with the central longitudinal axis forming a rigid connection. The cylindrical collar is mounted onto the arbor, wherein the arbor is able to rotate inside the collar.

In a further another aspect of the present invention, an appliqué film and paint treatment removal tool comprises a central rotating shaft, at least three post bearings, a cylindrical cavity, a locator pin, a spring, an arbor, a cylindrical collar, a jam nut, and a washer. The central rotating shaft has a cylindrical shape and a central longitudinal axis, the central rotating shaft extends along the axis, is rotatable about the axis, and includes a first end and a second end, wherein the first end has a conically shape and includes at least three cavities equidistant from the central longitudinal axis and evenly spaced about the first end. The central rotating shaft has an outer diameter determined by the size of the area from which the appliqué film or paint treatment need to be removed. Each of the at least three post bearings is inserted into a corresponding cavity of the at least three cavities of the first end of the central rotating shaft. The post bearings are able to rotate about themselves. The cylindrical cavity extends within the central rotating shaft along the central longitudinal axis from the first end to the second end, wherein the cylindrical cavity includes a first portion having a first diameter and a threaded second portion having a second diameter, and wherein the first diameter is smaller than the second diameter. The locator pin includes an elongated cylindrical body, a shoulder and a tip, wherein the locator pin is inserted into the cylindrical cavity, wherein the locator pin is movable along the central longitudinal axis, and wherein the body of the locator pin extends the first end of the central rotating shaft, and wherein the shoulder of the locator pin has a diameter larger than the first diameter of the first portion of the cylindrical cavity. The spring is placed into the cylindrical cavity following the locator pin. The arbor has an elongated cylindrical shape and includes a first end and a shank portion, wherein the threaded first end is screwed into the second portion of the cylindrical cavity extending coaxially with the central longitudinal axis forming a rigid connection. The cylindrical collar includes a guide bearing and is mounted onto the arbor, wherein the arbor is able to rotate inside the collar. The jam nut secures the collar proximate to the second end of the central rotating shaft. The washer is placed between the shoulder of the locator pin and the spring.

In still another aspect of the present invention, a method for locally removing appliqué film and paint treatment from a surface that includes at least one fastener having a fastener drive and forming a mold line with said surface, wherein an appliqué film or paint treatment has been applied to said surface covering said surface including said fastener forming a mold line contour around said fastener comprises the steps of: inserting a pin into the fastener drive of the fastener, providing contact of at least three bearings with the mold line contour around the fastener, wherein the bearings are located equidistant from the pin, rotating a shaft including the pin and the bearings, controlling the shaft during rotation, separating the appliqué film or paint treatment at the mold line of the fastener by rotating the bearings while touching the mold line contour of the fastener, peeling the separated appliqué film or paint treatment off, and providing access to the fastener.

In yet another aspect of the present invention, a method for locally removing appliqué film and paint treatment from a surface that includes at least one fastener having a fastener drive and forming a mold line with said surface, wherein an appliqué film or paint treatment has been applied to said surface covering said surface including said fastener forming a mold line contour around said fastener comprises the steps of: providing a surface including at least one fastener having a fastener drive and forming a mold line with the surface, wherein an appliqué film or paint treatment has been applied to the surface covering the surface including the fastener forming a mold line contour around the fastener; providing an appliqué film or paint treatment removal tool; inserting the locator pin into the fastener drive of the fastener; pushing the appliqué film or paint treatment removal tool toward the surface by depressing the spring until the bearings touch the mold line contour around the fastener; providing rotation to the central rotating shaft; controlling the appliqué film or paint treatment removal tool with the collar; separating the appliqué film or paint treatment at the mold line of the fastener by rotating the bearings about the central longitudinal axis and about themselves while touching the mold line contour of the fastener; peeling the separated appliqué film or paint treatment off; and providing access to the fastener.

These and other features, aspects and advantages of the present invention will become better understood with reference to the following drawings, description and claims.

DETAILED DESCRIPTION OF THE INVENTION

Figure 1:
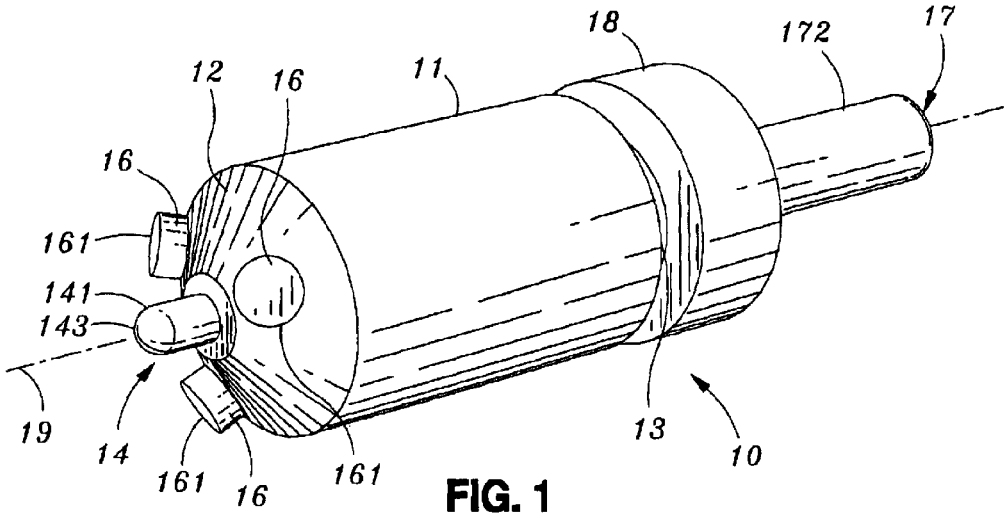
FIG. 1 is a perspective view of an appliqué film and paint treatment removal tool according to one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

An embodiment of the present invention provides an appliqué film and paint treatment removal tool that is suitable for, but not limited to, the removal of paint treatments or appliqué films from the door access fasteners after the application of paint treatments or appliqué films to the mold line surface of an aircraft. An embodiment of the present invention also provides an appliqué film and paint treatment removal tool that makes it possible to remove paint or appliqué material locally without damaging the aircraft structure by utilizing bearings instead of prior art sharp blades. In the prior art, such a tool is not available. An embodiment of the present invention further provides an inexpensive appliqué film and paint treatment removal tool that has a simple mechanical design, is relatively easy to operate at a low cost and with low maintenance. An embodiment of the present invention still further provides a method for removing the paint treatment and appliqué films locally using the tool of the present invention that allows the usage of advanced coatings and appliqué films on aircraft, which is not possible by using prior art methods.

An appliqué film and paint treatment removal tool according to one embodiment of the present invention will make it possible to introduce the usage of specialty coatings, such as appliqué films and advanced paint treatments, on military and commercial products, such as advanced aircraft, in the aerospace industry. Since the appliqué film and paint treatment removal tool of the present invention can be accurately positioned and centered by including a locator pin, can be controlled by including a collar, and can be rotated by attaching to a drill motor or similar tool the local removal of paint or appliqué material covering door access fasteners can be done relatively quickly, with reduced manual labor, and at a relatively low cost compared to prior art methods. Consequently, the need for the omission of paint treatment or appliqué film in the areas of the door access fasteners and a later application of alternate treatments as practiced in prior art can be eliminated, saving cost and time for aircraft fleet maintenance.

In one embodiment, the present invention provides an appliqué film and paint treatment removal tool that comprises a rotating tool and utilizes the edges of aligned bearings to extrude and separate appliqué films and paint treatments around fasteners. The separated circle of material can be peeled off over the fastener. Contrary to prior art, this is accomplished without the use of sharp cutting blades. Therefore, there is no risk of damaging the outer skins of the aircraft using the tool of the present invention as there is with prior art cutting tools.

In one embodiment, the present invention provides an appliqué film and paint treatment removal tool that includes a central rotating shaft with a spring-loaded locator pin. The locator pin can be inserted into the door access fastener drive to allow accurate positioning of the tool. The locator pin may have any shape or diameter to fit into any desired fastener type. Therefore, the appliqué film or paint treatment removal tool may be used universally with any fastener type.

In one embodiment, the present invention provides freely rotating bearings that may be attached to the central rotating shaft of the appliqué film and paint treatment removal tool equidistant from the location pin. Bearing distance from the locating pin, angle of mounting, bearing size, and shaft diameter can be designed to provide positive contact of the bearing edges to the mold line of the door access fasteners for appliqué film or paint treatment separation. Various types of bearings such as round ball bearings or spring-mounted roller bearings may be used depending on the mold line contours. The adjustability of the design allows the appliqué film and paint treatment removal tool to be manufactured to accommodate all fastener diameters and mold line contours. The appliqué film and paint treatment removal tool according to one embodiment may be used universally to locally remove paint and appliqué materials conveniently and at a low cost and therefore, the tool might be of interest for other industries, such as the automobile industry, that apply paint treatments or appliqué films to larger areas.

In one embodiment, the present invention provides a method for removing the paint treatment and appliqué film locally from the door access fasteners that reduces the cost and time needed for aircraft fleet maintenance compared to prior art methods and therefore, allows the usage of advanced coatings and appliqué films on aircraft.

Figure 2:
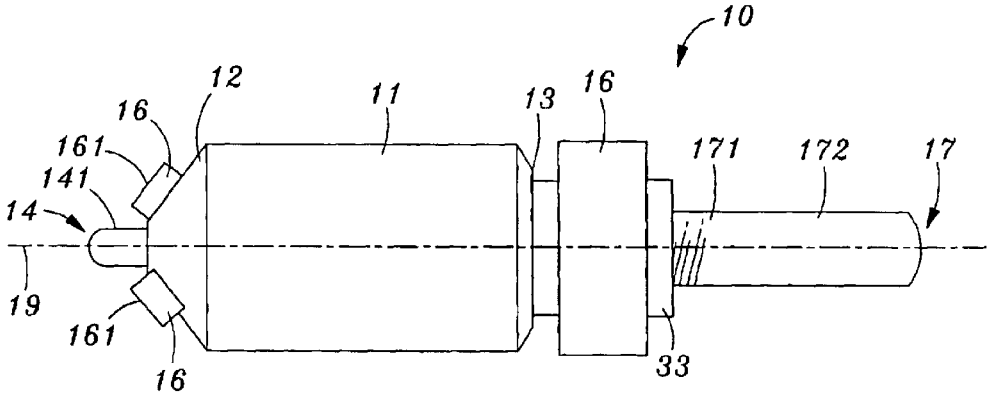
FIG. 2 is a side view of the appliqué film and paint treatment removal tool according to one embodiment of the present invention.
Figure 3:
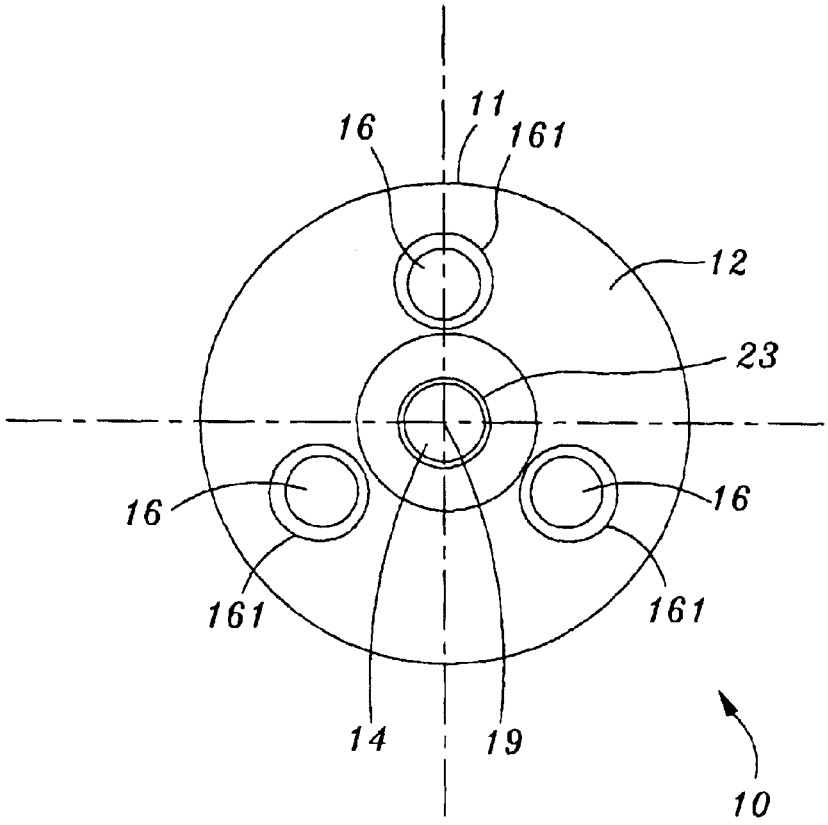
FIG. 3 is a front view of the appliqué film and paint treatment removal tool according to one embodiment of the present invention.

Referring now to FIGS. 1, 2, and 3, an appliqué film and paint treatment removal tool 10 is illustrated according to one embodiment of the present invention. The appliqué film and paint treatment removal tool 10 may include a central rotating shaft 11 having a first end 12 and a second end 13, a locator pin 14, a spring 15, at least three freely rotating bearings 16, an arbor 17, and a collar 18. The central rotating shaft 11 may have a generally cylindrical shape and extends along a central longitudinal axis 19. The central rotating shaft 11 may be rotatable about the central longitudinal axis 19. The central rotating shaft 11 may be made of sturdy material, such as aluminum or tool steel, capable of transmitting rotation torques about the central longitudinal axis 19. The locator pin 14 is spring-mounted into the first end of the rotating shaft 11 such that it can be pushed inside the rotating shaft 11 along the longitudinal axis 19 compressing the spring 15. The locator pin 14 may be used to center the tool 10. Further, the bearings 16 are mounted to the first end 12 of the rotating shaft 11 evenly spaced and equidistant from the central longitudinal axis 19 and therefore, from the locator pin 14 (as shown in FIG. 3). At least three bearings 16 are necessary to keep the tool 10 balanced. The arbor 17 may have a generally cylindrical elongated shape and may be attached to the second end 13 of the rotating shaft 11 such that it extends coaxially with the central longitudinal axis 19. The arbor 17 may be made of sturdy material, such as aluminum or tool steel, capable of transmitting rotation torques about the central longitudinal axis 19. The collar 18 may be mounted onto the arbor 17 proximate to the second end 13 of the central rotating shaft 11. Further, the collar 18 may have a generally cylindrical shape extending along the central longitudinal axis 19. The collar 18 may enable the operator to position and control the appliqué film or paint treatment removal tool 10 during use.

Figure 6:
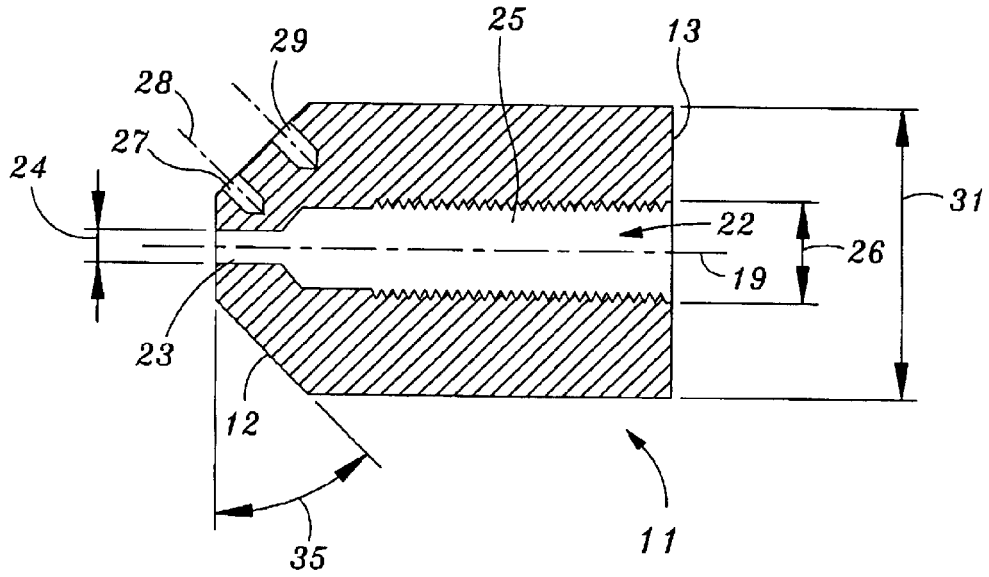
FIG. 6 is a cross-sectional view of a central rotating shaft of the appliqué film and paint treatment removal tool according to one embodiment of the present invention.

Referring now to FIG. 6, a cross-sectional view of the central rotating shaft 11 is illustrated according to one embodiment of the present invention. The central rotating shaft 11 may comprise an elongated generally cylindrical shape, may extend along the central longitudinal axis 19, and may have a first end 12 and a second end 13. The central rotating shaft 11 may further include a cylindrical cavity 22 extending within the central rotating shaft 11 along the central longitudinal axis 19 from the first end 12 to the second end 13. The cylindrical cavity 22 may comprise a first portion 23 having a first diameter 24 and a second portion 25 having a second diameter 26, wherein the first diameter 24 is smaller than the second diameter 25. The first portion 23 of the cylindrical cavity 22 may be designed to receive the locator pin 14. The second portion 15 of the cylindrical cavity 22 may be designed to receive the arbor 17 and may be threaded. The first end 12 of the central rotating shaft 11 may be conically shaped having an angle 35, wherein the preferred angle is 45°. The first end 12 may include at least three cylindrical cavities 27 for receiving the at least three bearings 16. The axis 28 of each cavity 27 may form a right angle with the conically shaped first end 12 of the central rotating shaft 11. The cavities 27 are evenly spaced about the conically shaped first end 12 and equidistant from the central longitudinal axis 19. The first end 12 may further include at least three cylindrical cavities 29 in addition to the at least three cavities 27. The at least three bearings 16 may be placed either into the cavities 27 or into the cavities 29 according to the diameter of the area from which the appliqué film or paint treatment is to be removed. Further, the outer diameter 31 of the central rotating shaft 11 may be chosen according to the area from which the appliqué or paint material needs to be removed.

Figure 7:
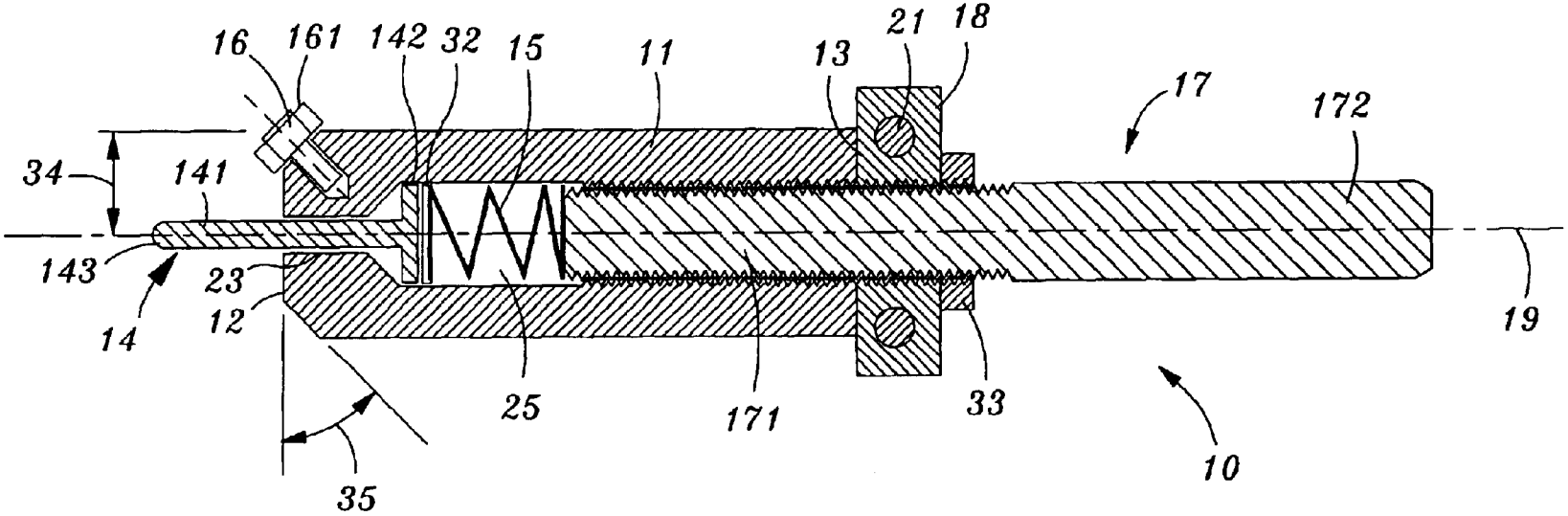
FIG. 7 is a cross-sectional view of the appliqué film and paint treatment removal tool according to one embodiment of the present invention.

Referring now to FIG. 7, a cross-sectional view of the appliqué film and paint treatment removal tool 10 is illustrated according to one embodiment of the present invention. The locator pin 14 may comprise an elongated body 141 having a generally cylindrical shape, a shoulder 142 having a diameter that extends the diameter of the body 141, and a tip 143. The tip 143 of the locator pin may be designed to fit into any fastener drive. The locator pin 14 may be inserted into the cylindrical cavity 22 of the central rotating shaft 11 from the second end 13 such that the body 142 of the locator pin 14 extends the first end 12 of the central rotating shaft 11. The body 141 of the locator pin 14 may fit movably into the first portion 23 of the cylindrical cavity such that the locator pin 12 can be moved along the central longitudinal axis 19. The shoulder 142 of the locator pin 14 may have a larger diameter than the first portion 23 of the cylindrical cavity 22 and, therefore, may fit only into the second portion 25 of the cylindrical cavity 22 preventing the locator pin 14 from falling out of the cylindrical cavity 22. Following the locator pin 14 a washer 32 and the spring 15 may be inserted into the cylindrical cavity 22 of the central rotating shaft 11 from the second end 13. Both, the washer 32 and the spring 15 fit movably into the second portion 25 of the cylindrical cavity 22. The spring 15 may comprise a relative great stiffness. Following the spring the arbor 17 may be disposed into the cylindrical cavity 22 of the central, rotating shaft 11 from the second end 13. The arbor 17 may comprise a threaded first end 171 that can be screwed into the threaded second portion 25 of the cylindrical cavity 22 of the central rotating shaft 11 such that the arbor 17 and the central rotating shaft 11 form a rigid connection. After disposing the arbor 17 into the cavity 22 of the central rotating shaft 11 the first threaded end 171 of the arbor 17 also functions as a barrier for the spring 15. The first threaded end 171 of the arbor 17 may extend the second end 13 of the central rotating shaft 11 to receive the collar 18. The collar 18 may include a guide bearing 21 and may be secured on the arbor 17 proximate to the second end 13 of the central rotating shaft 11 using a jam nut 33. The collar 18 may be designed to allow the rotation of the arbor 17 and to enable the operator to position and to control the appliqué film or paint treatment removal tool 10. The arbor 17 may further comprise a shank portion 172. The shank portion 172 of the arbor 17 may be connected to a tool providing rotation, such as a hand held mechanical screwdriver or a drill motor. Consequently, a rotation drive may be applied with a tool, such as a hand held mechanical screwdriver or a drill motor, to the arbor 17 and from the arbor 17 to the central rotating shaft 11.

Figure 4:
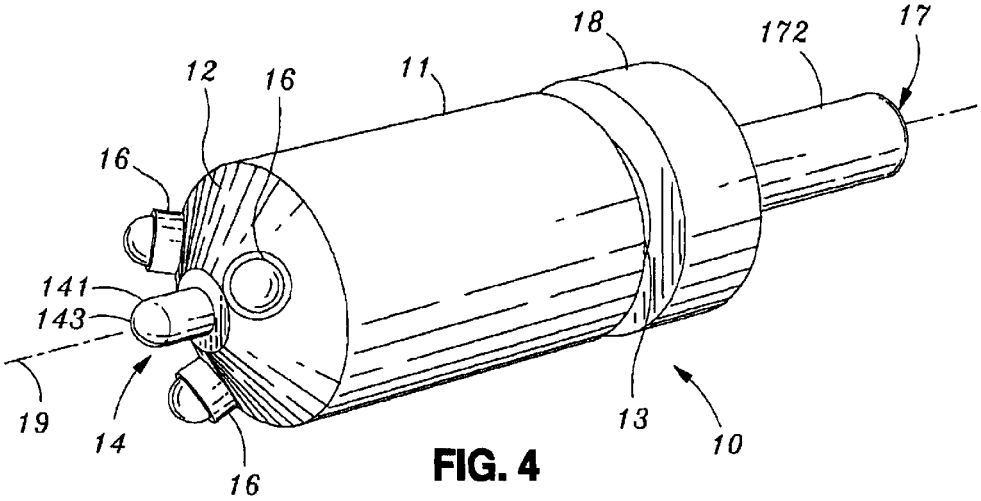
FIG. 4 is a perspective view of an appliqué film and paint treatment removal tool according to another embodiment of the present invention.
Figure 5:
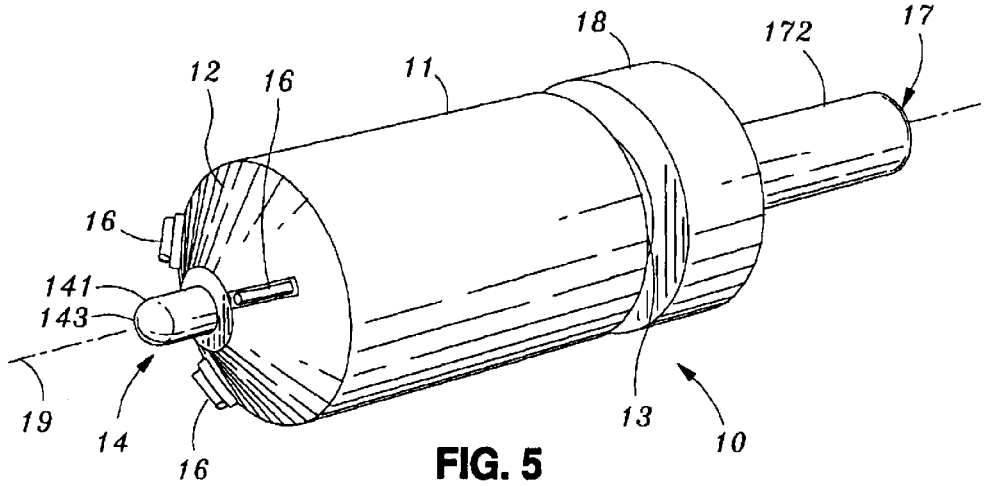
FIG. 5 is a perspective view of an appliqué film and paint treatment removal tool according to another embodiment of the present invention.

Still referring to FIG. 7, at least three bearings 16 may be attached to the conical first end 12 of the central rotating shaft 11. The bearings 16 may comprise post bearings (as shown in FIGS. 1, 2, 3, and 7) that have a generally cylindrical body including edge 161. The bearings 16 may be attached to the first end of the central rotating shaft 11 by pushing each of the bearings 16 into the corresponding cavity 27 (shown in FIG. 6) such that the bearings 16 can rotate freely. Further, the at least three bearings 16 may be attached to the first end 12 of the central rotating shaft 11 evenly spaced around the perimeter of the first end 12 and equidistant from the central longitudinal axis 19 and therefore, from the locator pin 12 (as shown in FIG. 3). The distance 34 of the bearings 16 from the central longitudinal axis 19 equals the radius of the area from which the appliqué or paint material will be removed. The distance 34 of the bearings 16 from the central longitudinal axis 19, the angle 35 of the first end 12 of the central rotating shaft 11, and the size of the bearings 16 may be designed to provide positive contact of the edges 161 of the bearings 16 to the mold line of a door access fastener of an aircraft for appliqué film or paint treatment separation. Alternate types of bearings 16 such as round ball bearings (shown in FIG. 4) or spring-mounted roller bearings (shown in FIG. 5) may be used according to the shape of the mold line contour.

A method for locally removing appliqué film and paint treatment from a surface that includes at least one fastener having a fastener drive and forming a mold line with the surface, may include the steps of: inserting a pin 14 into the fastener drive of the fastener, providing contact of at least three bearings 16 with the mold line contour around the fastener, rotating a shaft 11 including the pin 14 and the bearings 16, controlling the shaft 11 during rotation, separating the appliqué film or paint treatment at the mold line of the fastener by rotating the bearings 16 while touching the mold line contour of the fastener, peeling the separated appliqué film or paint treatment off, and providing access to the fastener. The appliqué film or paint treatment has been applied to the surface and covers the surface including the fastener forming a mold line contour around the fastener. The surface may be a mold line surface of an aircraft including door access fasteners.

In use, the spring-loaded locator pin 14 of the appliqué film and paint treatment removal tool 10 may be inserted into the fastener drive of the door access fastener to allow accurate positioning of the tool 10 and accurate material removal around the fastener. The locator pin 14 may be made to any diameter or shape to work with any given fastener type. After inserting the locator pin 14 into a fastener drive the central rotating shaft 11 of the appliqué film and paint treatment removal tool 10 may be pushed toward the treated surface depressing the spring 15 until the edges 36 of the bearings 16 touch the surface from which the appliqué0 or paint material is to be removed. The bearings 16 may be located equidistant from the pin 14. A separate tool, such as a handheld mechanized screwdriver or a drill motor, which may be connected to the shank portion 172 of the arbor 17, may provide rotation to the appliqué film or paint treatment removal tool 10. Consequently, the bearings 16 will rotate about the central longitudinal axis 19 as well as about themselves while touching the mold line contour of the door access fastener. This will cause the appliqué film or paint treatment to separate at the mold line of the fastener due to a shearing action. The separated appliqué film or paint treatment may than be peeled off and the door access fastener is accessible. To enable the easy removal of the separated appliqué film or paint treatment from the fasteners this method should be applied before the full bond of the appliqué film with the surface is reached.

Therefore, by using the appliqué film and paint treatment removal tool 10 of the present invention, the appliqué film or paint treatment can be removed from the door access fasteners without cutting into the skin of the aircraft. The adjustability of the design of the appliqué film and paint treatment removal tool 10 allows the tool 10 to be manufactured to accommodate all fastener diameters and mold line contours. Although, the appliqué film and paint treatment removal tool 10 has been disclosed for use in removal of appliqué or paint material from door access fasteners of an aircraft, it may be used for other applications as well.

It should be understood, of course, that the foregoing relates to preferred embodiments of the invention and that modifications may be made without departing from the spirit and scope of the invention as set forth in the following claims.

We claim:

1. An appliqué film and paint treatment removal tool, comprising:

a central rotating shaft having a cylindrical shape and a central longitudinal axis, said central rotating shaft extending along said axis, being rotatable about said axis, and including a first end and a second end, wherein said first end has a conically shape and includes at least three cavities equidistant from said central longitudinal axis and evenly spaced about said first end;

at least three bearings, wherein each of said bearings is inserted into a corresponding cavity of said at least three cavities of said first end of said central rotating shaft;

a cylindrical cavity extending within said central rotating shaft along said central longitudinal axis, from said first end to said second end, wherein said cylindrical cavity includes a first portion having a first diameter and a second portion having a second diameter, and wherein said first diameter is smaller than said second diameter;

a locator pin including an elongated body, a shoulder and a tip, wherein said locator pin is inserted into said cylindrical cavity, wherein said locator pin is movable along said central longitudinal axis, and wherein said body of said locator pin extends said first end of said central rotating shaft, and wherein said shoulder of said locator pin has a diameter larger than said first diameter of said first portion of said cylindrical cavity;

a spring placed into said cylindrical cavity following said locator pin;

an arbor having an elongated cylindrical shape and including a first end and a shank portion, wherein said first end is disposed into said second portion of said cylindrical cavity extending coaxially with said central longitudinal axis forming a rigid connection; and a collar mounted onto said arbor, wherein said arbor is able to rotate inside said collar.

2. The appliqué film and paint treatment removal tool of claim 1, wherein said central rotating shaft has an outer diameter determined by the size of the area from which the appliqué film or paint treatment needs to be removed.

3. The appliqué film and paint treatment removal tool of claim 1, wherein said second portion of said cylindrical cavity of said central rotating shaft is threaded, wherein said first end of said arbor is threaded, and wherein said first end of said arbor is screwed into said second portion of said cylindrical cavity of said central rotating shaft.

4. The appliqué film and paint treatment removal tool of claim 1, wherein said collar includes a guide bearing.

5. The appliqué film and paint treatment removal tool of claim 1, wherein said central rotating shaft is made of a sturdy material capable of transmitting rotation torques about said central longitudinal axis.

6. The appliqué film and paint treatment removal tool of claim 1, wherein said arbor is made of a sturdy material capable of transmitting rotation torques about said central longitudinal axis.

7. The appliqué film and paint treatment removal tool of claim 1, wherein said bearings comprise post bearings having a cylindrical body, and wherein said bearings are able to rotate freely about themselves.

8. The appliqué film and paint treatment removal tool of claim 1, wherein said bearings comprise round-ball bearings.

9. The appliqué film and paint treatment removal tool of claim 1, wherein said bearings comprise spring-mounted roller bearings.

10. The appliqué film and paint treatment removal tool of claim 1, further comprising a tool providing rotation to said arbor and said central rotating shaft, and wherein said tool is connected with said shank portion of said arbor.

11. An appliqué film and paint treatment removal tool, comprising:

a central rotating shaft having a cylindrical shape and a central longitudinal axis, said central rotating shaft extending along said axis, being rotatable about said axis, and including a first end and a second end, wherein said first end has a conically shape and includes at least three cavities equidistant from said central longitudinal axis and evenly spaced about said first end;

at least three post bearings having a cylindrical body, wherein each of said post bearings is inserted into a corresponding cavity of said at least three cavities of said first end of said central rotating shaft, and wherein said post bearings are able to rotate freely about themselves;

a cylindrical cavity extending within said central rotating shaft along said central longitudinal axis from said first end to said second end, wherein said cylindrical cavity includes a first portion having a first diameter and a second portion having a second diameter, and wherein said first diameter is smaller than said second diameter;

a locator pin including an elongated body, a shoulder and a tip, wherein said locator pin is inserted into said cylindrical cavity, wherein said locator pin is movable along said central longitudinal axis, and wherein said body of said locator pin extends said first end of said central rotating shaft, and wherein said shoulder of said locator pin has a diameter larger than said first diameter of said first portion of said cylindrical cavity;

a spring placed into said cylindrical cavity following the locator pin;

an arbor having an elongated cylindrical shape and including a first end and a shank portion, wherein:said first end is disposed into said second portion of said cylindrical cavity extending coaxially with said central longitudinal axis; and a cylindrical collar mounted onto said arbor, wherein said arbor is able to rotate inside said collar.

12. The appliqué film and paint treatment removal tool of claim 11, wherein said central rotating shaft is made of aluminum.

13. The appliqué film and paint treatment removal tool of claim 11, wherein said arbor is made of aluminum.

14. The appliqué film and paint treatment removal tool of claim 11, wherein said locator pin has a cylindrical shape.

15. The appliqué film and paint treatment removal tool of claim 11, further comprising a hand held mechanical screwdriver providing rotation to said arbor and said central rotating shaft, wherein said screwdriver is attached to said shank portion of said arbor.

16. The appliqué film and paint treatment removal tool of claim 11, wherein said appliqué film and paint treatment removal tool comprises an aircraft specialty coating removal tool.

17. An aircraft appliqué film and paint treatment removal tool, comprising:

a central rotating shaft having a cylindrical shape and a central longitudinal axis, said central rotating shaft extending along said axis, being rotatable about said axis, and including a first end and a second end, wherein said first end has a conically shape and includes at least three cavities equidistant from said central longitudinal axis and evenly spaced about said first end;

at least three round ball bearings, wherein each of said round ball bearings is inserted into a corresponding cavity of said at least three cavities of said first end of said central rotating shaft;

a cylindrical cavity extending within said central rotating shaft along said central longitudinal axis from said first end to said second end, wherein said cylindrical cavity includes a first portion having a first diameter and a second portion having a second diameter, and wherein said first diameter is smaller than said second diameter;

a locator pin including an elongated cylindrical body, a shoulder and a tip, wherein said locator pin is inserted into said cylindrical cavity, wherein said locator pin is movable along said central longitudinal axis, and wherein said body of said locator pin extends said first end of said central rotating shaft, and wherein said shoulder of said locator pin has a diameter larger than said first diameter of said first portion of said cylindrical cavity;

a spring placed into said cylindrical cavity following the locator pin;

an arbor having an elongated cylindrical shape and including a first end and a shank portion, wherein said first end is disposed into said second portion of said cylindrical cavity extending coaxially with said central longitudinal axis; and a cylindrical collar mounted onto said arbor, wherein said arbor is able to rotate inside said collar.

18. The aircraft appliqué film and paint treatment removal tool of claim 17, further comprising a drill motor providing rotation to said arbor and said central rotating shaft, wherein said drill motor is attached to said shank portion of said arbor.

19. The aircraft appliqué film and paint treatment removal tool of claim 17, wherein said collar is mounted onto said arbor proximate to said second end of said central rotating shaft.

20. The aircraft appliqué film and paint treatment removal tool of claim 17, further comprising a jam nut, wherein said jam nut secures said collar proximate to said second end of said central rotating shaft.

21. The aircraft appliqué film and paint treatment removal tool of claim 17, further comprising a washer placed between said shoulder of said locator pin and said spring.

22. An appliqué film and paint treatment removal tool, comprising:

a central rotating shaft having a cylindrical shape and a central longitudinal axis, said central rotating shaft extending along said axis, being rotatable about said axis, and including a first end and a second end, wherein said first end has a conically shape and includes at least three cavities equidistant from said central longitudinal axis and evenly spaced about said first end, and wherein said central rotating shaft has an outer diameter determined by the size of the area from which the appliqué film or paint treatment needs to be removed;

at least three post bearings, each having a cylindrical body, wherein each of said post bearings is inserted into a corresponding cavity of said at least three cavities of said first end of said central rotating shaft, and wherein said post bearings are able to rotate freely about themselves;

a cylindrical cavity extending within said central rotating shaft along said central longitudinal axis from said first end to said second end, wherein said cylindrical cavity includes a first portion having a first diameter and a second portion having a second diameter, and wherein said first diameter is smaller than said second diameter, and wherein said first portion is threaded;

a locator pin including an elongated cylindrical body, a shoulder and a tip, wherein said locator pin is inserted into said cylindrical cavity, wherein said locator pin is movable along said central longitudinal axis, and wherein said body of said locator pin extends said first end of said central rotating shaft, and wherein said shoulder of said locator pin has a diameter larger than said first diameter of said first portion of said cylindrical cavity;

a spring placed into said cylindrical cavity following the locator pin;

an arbor having an elongated cylindrical shape and including a threaded first end and a shank portion, wherein said first end is screwed into said second portion of said cylindrical cavity extending coaxially with said central longitudinal axis and forming a rigid connection;

a cylindrical collar including a guide bearing, wherein said collar is mounted onto said arbor, and wherein said arbor is able to rotate inside said collar;

a jam nut, wherein said jam nut secures said collar proximate to said second end of said central rotating shaft; and a washer placed between said shoulder of said locator pin and said spring.

23. The appliqué film and paint treatment removal tool of claim 22, further comprising at least three additional cavities included in said first end of said central rotating shaft equidistant from said central longitudinal axis and evenly spaced about said first end, wherein the distance from said central longitudinal axis of said at least three cavities is different from the distance from said central longitudinal axis of said at least three additional cavities.

24. The appliqué film and paint treatment removal tool of claim 22, wherein said rotating shaft is made of tool steel.

25. The appliqué film and paint treatment removal tool of claim 22, wherein said arbor is made of tool steel.

26. The appliqué film and paint treatment removal tool of claim 22, further comprising a tool selected from the group of a handheld mechanized screwdriver and a drill motor, wherein said tool provides rotation to said arbor and said central rotating shaft, and wherein said tool is attached to said shank portion of said arbor.

27. A method for locally removing appliqué film and paint treatment from a surface that includes at least one fastener having a fastener drive and forming a mold line with said surface, wherein an appliqué film or paint treatment has been applied to said surface, covering said surface including said fastener, and forming a mold line contour around said fastener, said method comprising the steps of:

inserting a pin into said fastener drive of said fastener;

providing contact of at least three bearings with said mold line contour around said fastener, wherein said bearings are located equidistant from said pin;

rotating a shaft including said pin and said bearings;

controlling said shaft during rotation;

separating said appliqué film or paint treatment at said mold line of said fastener by rotating said bearings while touching said mold line contour of said fastener;

peeling said separated appliqué film or paint treatment off; and providing access to said fastener.

28. A method for locally removing appliqué film and paint treatment from a surface that includes at least one fastener having a fastener drive and forming a mold line with said surface, wherein an appliqué film or paint treatment has been applied to said surface covering said surface including said fastener forming a mold line contour around said fastener, comprising the steps of:

providing an appliqué film and paint treatment removal tool including:

a central rotating shaft having a cylindrical shape and a central longitudinal axis, said central rotating shaft extending along said axis, being rotatable about said axis, and including a conical first end and a second end, wherein said first end includes at least three cavities equidistant from said central longitudinal axis and evenly spaced about said first end;

at least three bearings, wherein each of said bearings is inserted into a corresponding cavity of said at least three cavities of said first end of said central rotating shaft;

a cylindrical cavity extending within said central rotating shaft along said central longitudinal axis from said first end to said second end, wherein said cylindrical cavity includes a first portion having a first diameter and a second portion having a second diameter, and wherein said first diameter is smaller than said second diameter;

a locator pin including an elongated body, a shoulder and a tip, wherein said locator pin is inserted into said cylindrical cavity, wherein said locator pin is movable along said central longitudinal axis, and wherein said body of said locator pin extends said first end of said central rotating shaft, and wherein said shoulder of said locator pin has a diameter larger than said first diameter of said first portion of said cylindrical cavity;

a spring placed into said cylindrical cavity following the locator pin;

an arbor having an elongated cylindrical shape and including a first end and a shank portion, wherein said first end is disposed into said second portion of said cylindrical cavity extending coaxially with said central longitudinal axis; and a collar mounted onto said arbor, wherein said arbor is able to rotate inside said collar;

inserting said tip of said locator pin into said fastener drive of said fastener;

pushing said appliqué film and paint treatment removal tool toward said surface by depressing said spring until said bearings touch said mold line contour around said fastener;

providing rotation to said central rotating shaft;

controlling said appliqué film and paint treatment removal tool with said collar;

separating said appliqué film or paint treatment at said mold line of said fastener by rotating said bearings about said central longitudinal axis and about themselves while touching said mold line contour of said fastener;

peeling said separated appliqué film or paint treatment off; and providing access to said fastener.

29. The method for locally removing appliqué film and paint treatment of claim 28, further comprising the steps of:

providing a drill motor;

attaching said drill motor to said shank portion of said arbor; and providing rotation to said shank portion of said arbor and to said central rotating shaft with said drill motor.

30. The method for locally removing appliqué film and paint treatment of claim 29, wherein said surface is a mold line surface of an aircraft including door access fasteners.

31. The method for locally removing appliqué film and paint treatment of claim 28, further comprising a step of adjusting the design of said appliqué film and paint treatment removal tool to accommodate the diameter of said fastener and the shape of said mold line contour.

32. The method for locally removing appliqué film and paint treatment of claim 28, further comprising a step of adjusting the design of said tip of said locator pin to accommodate the shape of said fastener drive.

* * * * *